US011103088B2

(12) United States Patent
Vondra et al.

(10) Patent No.: US 11,103,088 B2
(45) Date of Patent: Aug. 31, 2021

(54) PROMOTIONAL CHAIR SLEEVE

(71) Applicants: Justin V Vondra, Oregon, WI (US); Patrick W Cowan, Brooklyn, WI (US)

(72) Inventors: Justin V Vondra, Oregon, WI (US); Patrick W Cowan, Brooklyn, WI (US)

( * ) Notice: Subject to any disclaimer, the term of this patent is extended or adjusted under 35 U.S.C. 154(b) by 0 days.

(21) Appl. No.: 16/991,441

(22) Filed: Aug. 12, 2020

(65) Prior Publication Data

US 2021/0045542 A1 Feb. 18, 2021

Related U.S. Application Data

(60) Provisional application No. 62/885,669, filed on Aug. 12, 2019.

(51) Int. Cl.
*A47C 31/11* (2006.01)
*G09F 23/00* (2006.01)

(52) U.S. Cl.
CPC ..... *A47C 31/11* (2013.01); *G09F 23/00* (2013.01); *G09F 2023/005* (2013.01)

(58) Field of Classification Search
CPC . A47C 31/11; A47C 7/62; G09F 23/00; G09F 2023/005; G09F 2007/1886
See application file for complete search history.

(56) References Cited

U.S. PATENT DOCUMENTS 2,908,766 A * 10/1959 Taylor ..... H04B 5/00 381/79
4,945,587 A * 8/1990 Ferro ..... A47C 1/146 297/377
5,802,643 A * 9/1998 Sloot ..... A47C 7/425 297/220
6,899,391 B1 * 5/2005 Schneller ..... A47C 1/13 297/188.04
D586,168 S * 2/2009 Smith, Jr. ..... D6/611
7,665,804 B1 * 2/2010 Jeffrey ..... B60N 2/6063 297/220
8,104,119 B2 * 1/2012 Truex ..... A47C 21/00 5/482
2002/0074839 A1 * 6/2002 Mahan ..... A47C 7/425 297/228.1
2002/0116846 A1 * 8/2002 Wu ..... G09F 7/00 40/320
2002/0195845 A1 * 12/2002 Southwick ..... A47C 7/62 297/188.06
2003/0015899 A1 * 1/2003 Clay ..... A47C 31/116 297/219.1
2004/0251720 A1 * 12/2004 Micheletti ..... A47C 7/386 297/228.1
2007/0007803 A1 * 1/2007 Lawler ..... A47C 31/11 297/228.1
2009/0108647 A1 * 4/2009 Bowman ..... A47C 31/11 297/217.1

(Continued)

*Primary Examiner* — Gary C Hoge
(74) *Attorney, Agent, or Firm* — Patrick M. Bergin

(57) ABSTRACT

The invention relates to a chair slipcover or sleeve which is sized to slide over a variety of camp chairs and other collapsible outdoor chairs. More specifically, the claimed invention is directe to a strap, a pair of straps or a continuous strap and a display panel or a pair of display panels. The display panels can show a message or display the name of a favorite sporting team. Panels can also be designed to show sponsorship information.

5 Claims, 16 Drawing Sheets

(56) References Cited

U.S. PATENT DOCUMENTS

| | | | | |
|---|---|---|---|---|
| 2013/0320720 | A1* | 12/2013 | Steinmetz | G09F 23/06 297/219.1 |
| 2014/0084646 | A1* | 3/2014 | Benden | A47C 7/62 297/217.1 |
| 2015/0115674 | A1* | 4/2015 | Watson | A47C 31/11 297/220 |
| 2016/0213164 | A1* | 7/2016 | Pittman | A47C 7/622 |

* cited by examiner

PROMOTIONAL CHAIR SLEEVE

FIELD AND BACKGROUND OF THE INVENTION

The invention relates generally to the field of chair slipcovers, and in particular to a new and useful slipcover for attractively covering camp chairs and other outdoor chairs. While slipcovers are known in the art, to date, there has been no effective slipcover devised that is adaptable to multiple different types of outdoor chairs and that provides branding opportunities.

SUMMARY OF THE INVENTION

The invention relates to a chair slipcover or sleeve which is sized to slide over a variety of camp chairs and other collapsible outdoor chairs. Generally the invention is comprised of a strap, a pair of straps or a continuous strap and a display panel or a pair of display panels. The display panels can show a message or display the name of a favorite sporting team. Panels can also be designed to show sponsorship information.

DESCRIPTION OF THE INVENTION

Figure 1:
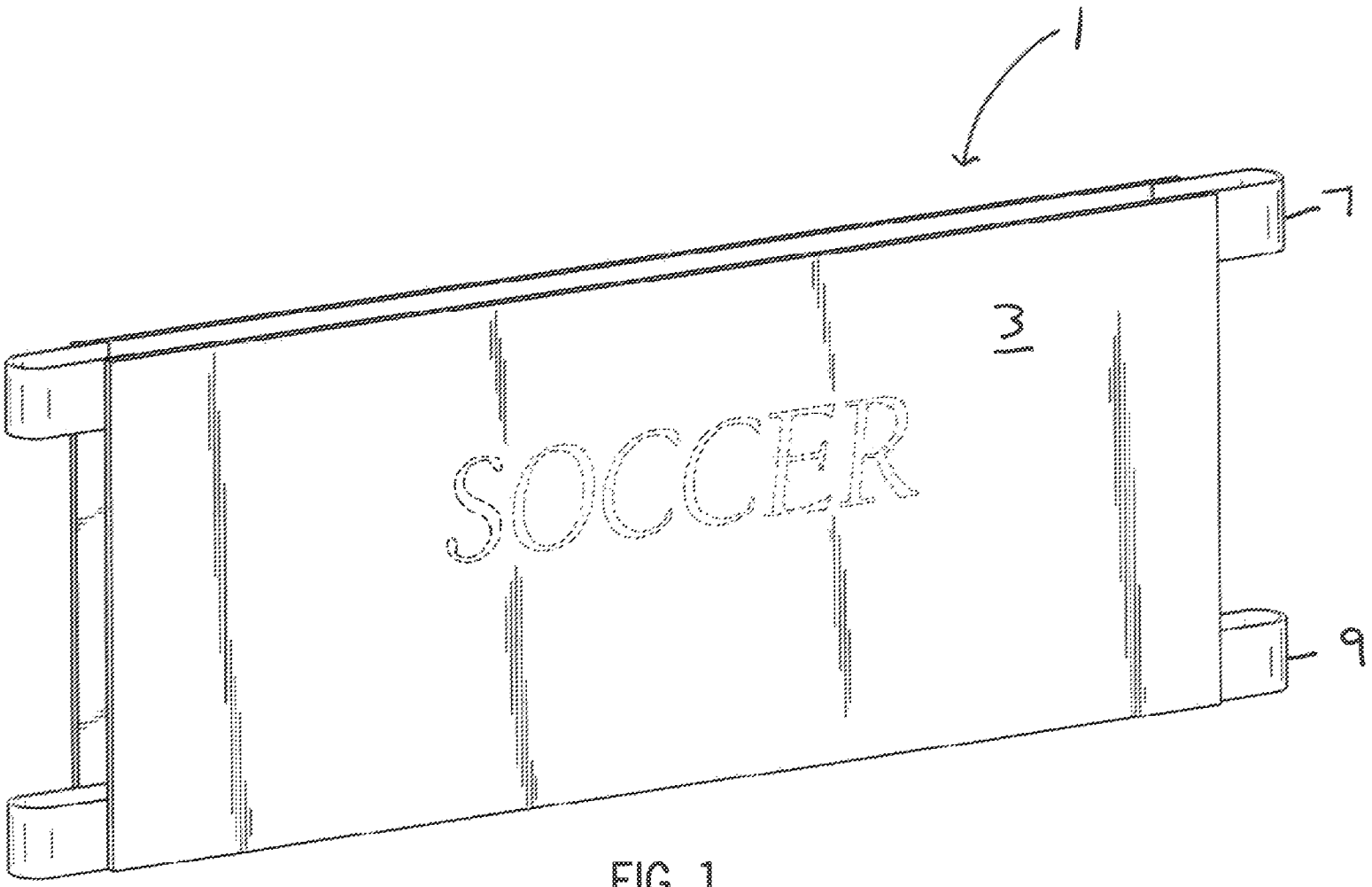
FIG. 1 is a front and side perspective view of the two-strap two-panel version of the chair sleeve invention.
Figure 2:
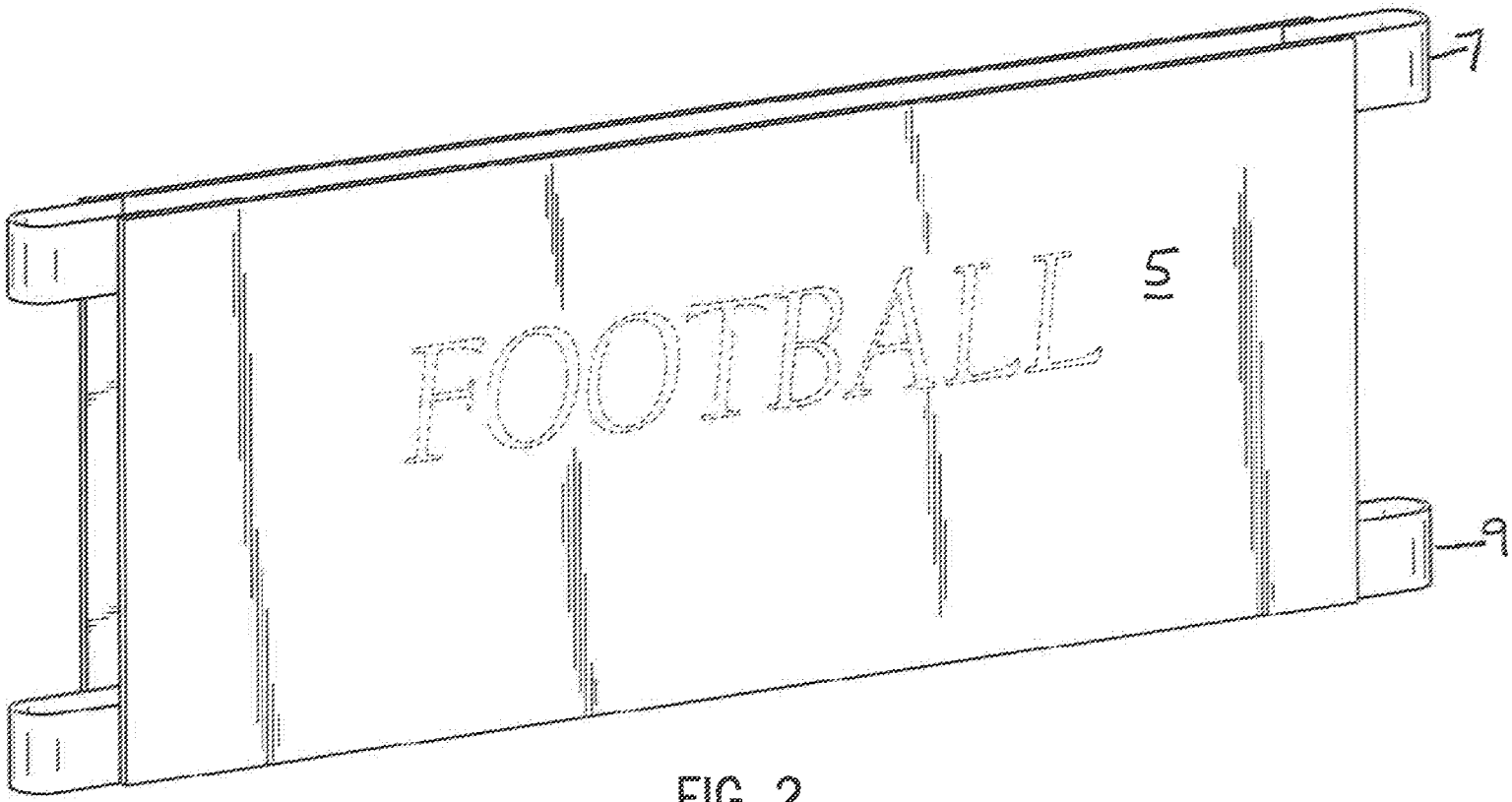
FIG. 2 is a rear and side perspective view of the two-strap two-panel version of the chair sleeve invention.
Figure 3:
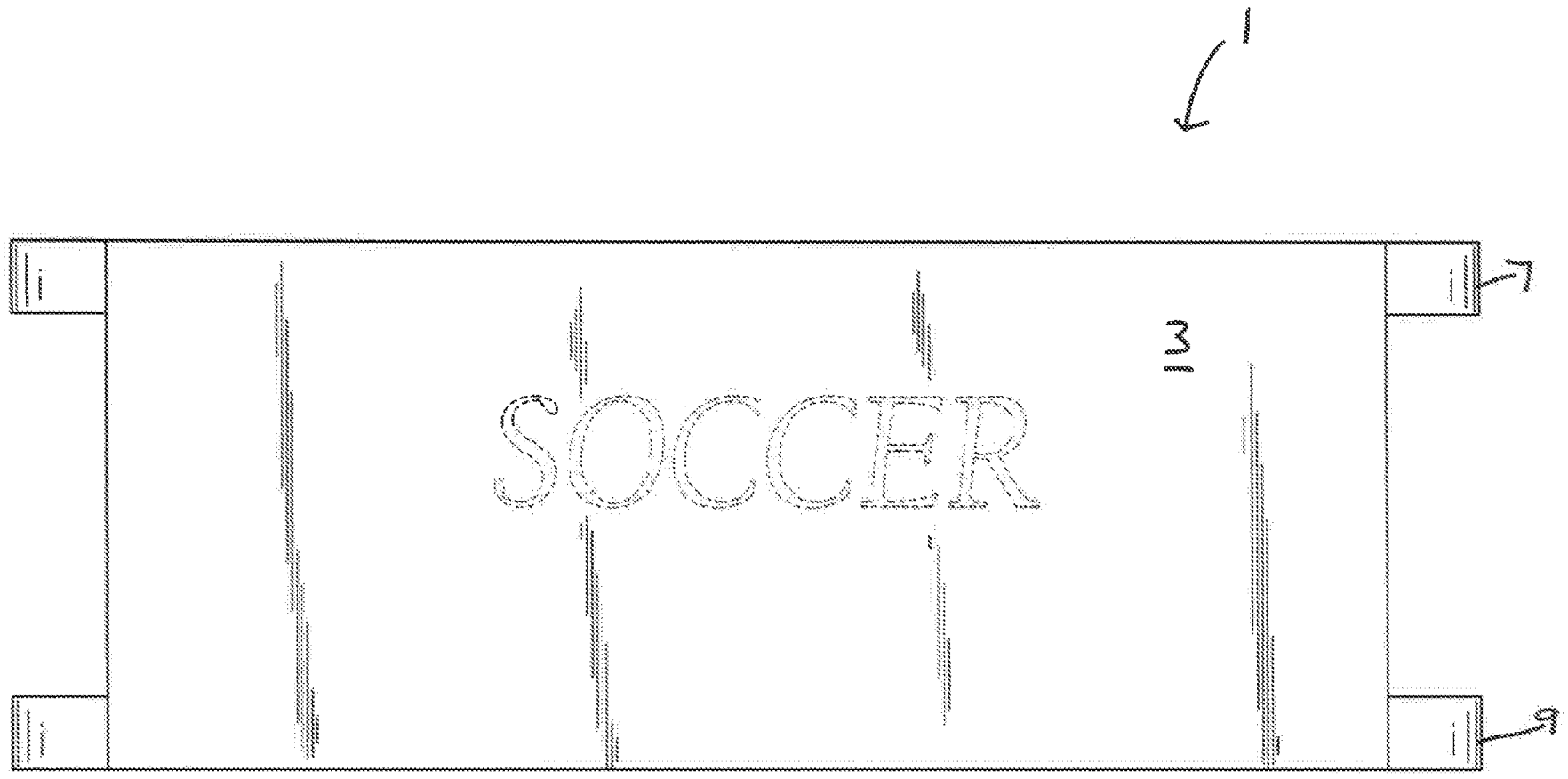
FIG. 3 is a front elevational view of the two-strap two-panel version of the chair sleeve invention.
Figure 4:
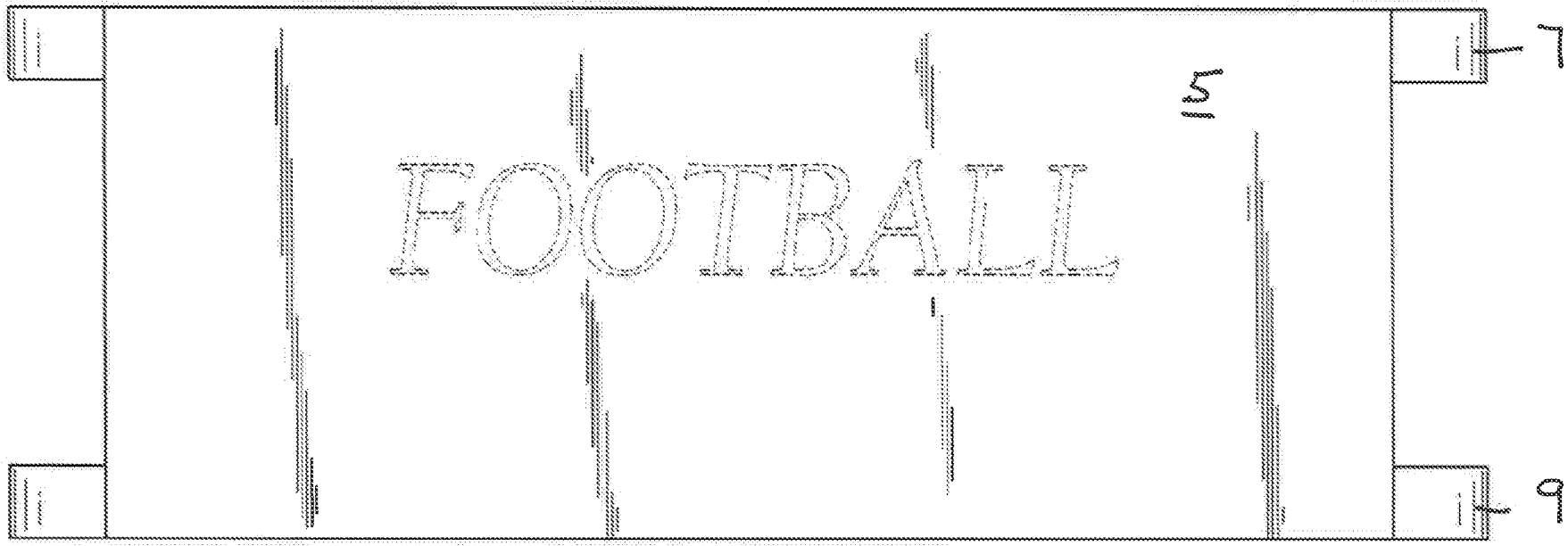
FIG. 4 is a rear elevational view of the two-strap two-panel version of the chair sleeve invention.
Figure 5:
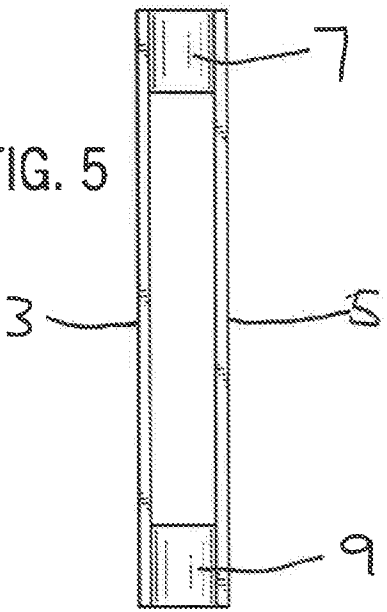
FIG. 5 is a side elevational view of the two-strap two-panel version of the chair sleeve invention.
Figure 6:
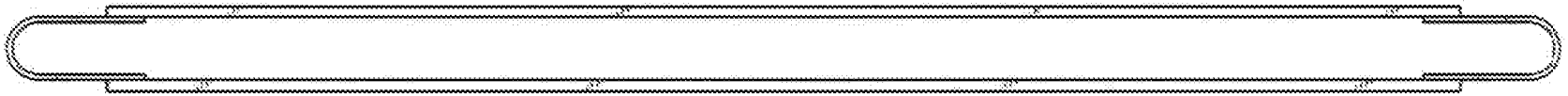
FIG. 6 is a top elevational view of the two-strap two-panel version of the chair sleeve invention.
Figure 7:
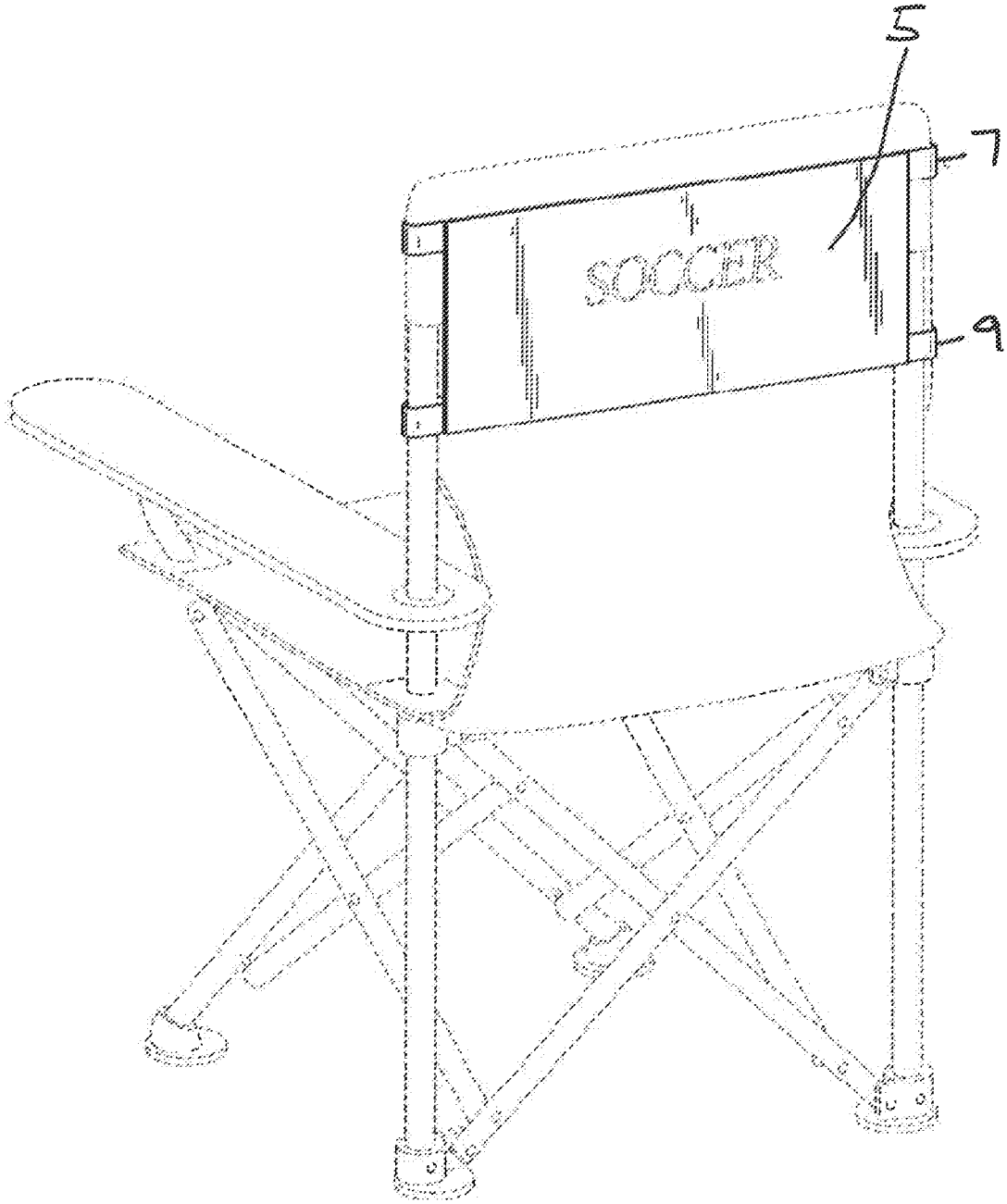
FIG. 7 is a rear and side perspective view of the two-strap two-panel version of the chair sleeve invention installed on a collapsible camp chair.
Figure 8:
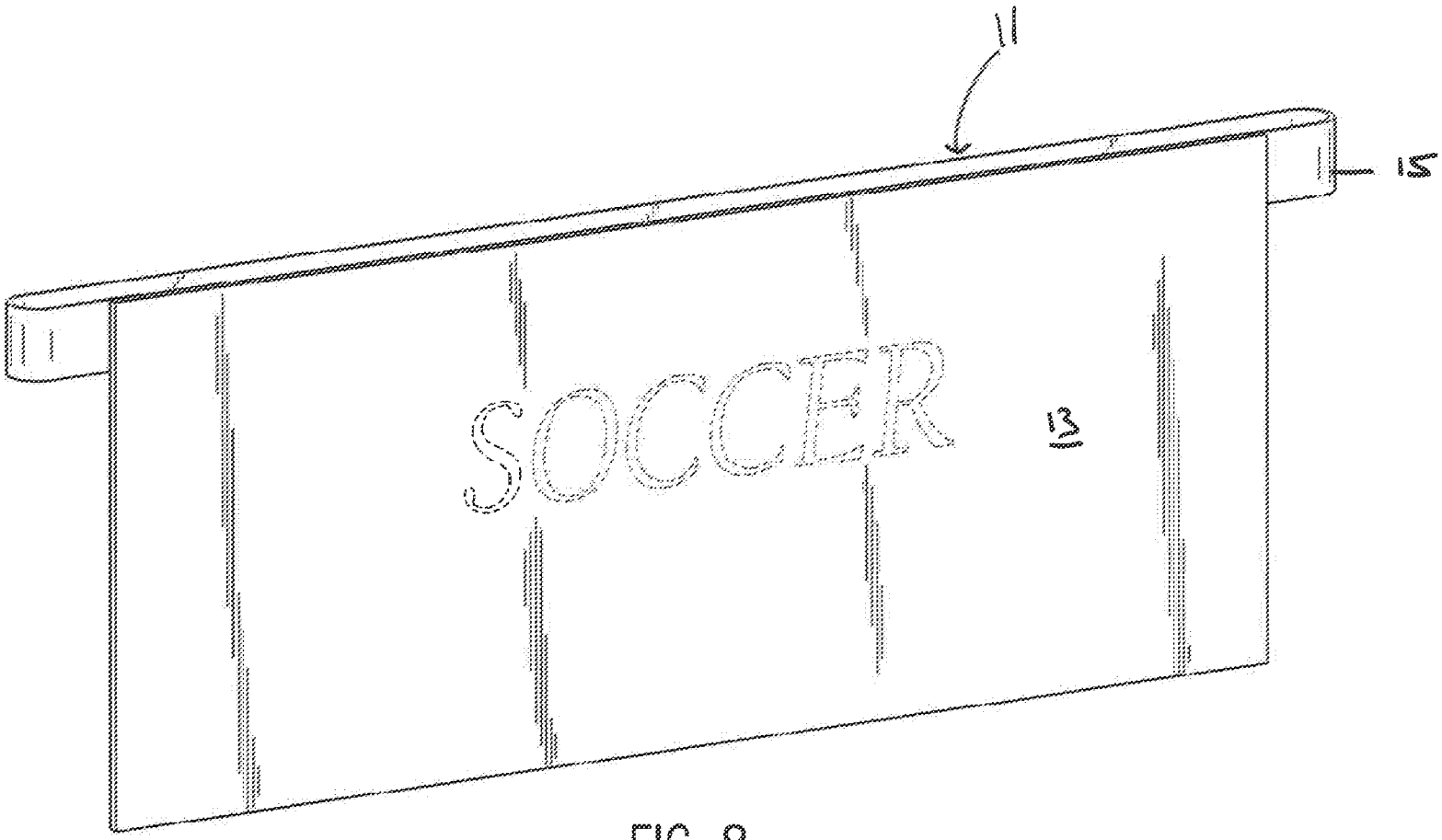
FIG. 8 is a front and side perspective view of the single-strap one-panel version of the chair sleeve invention.
Figure 9:
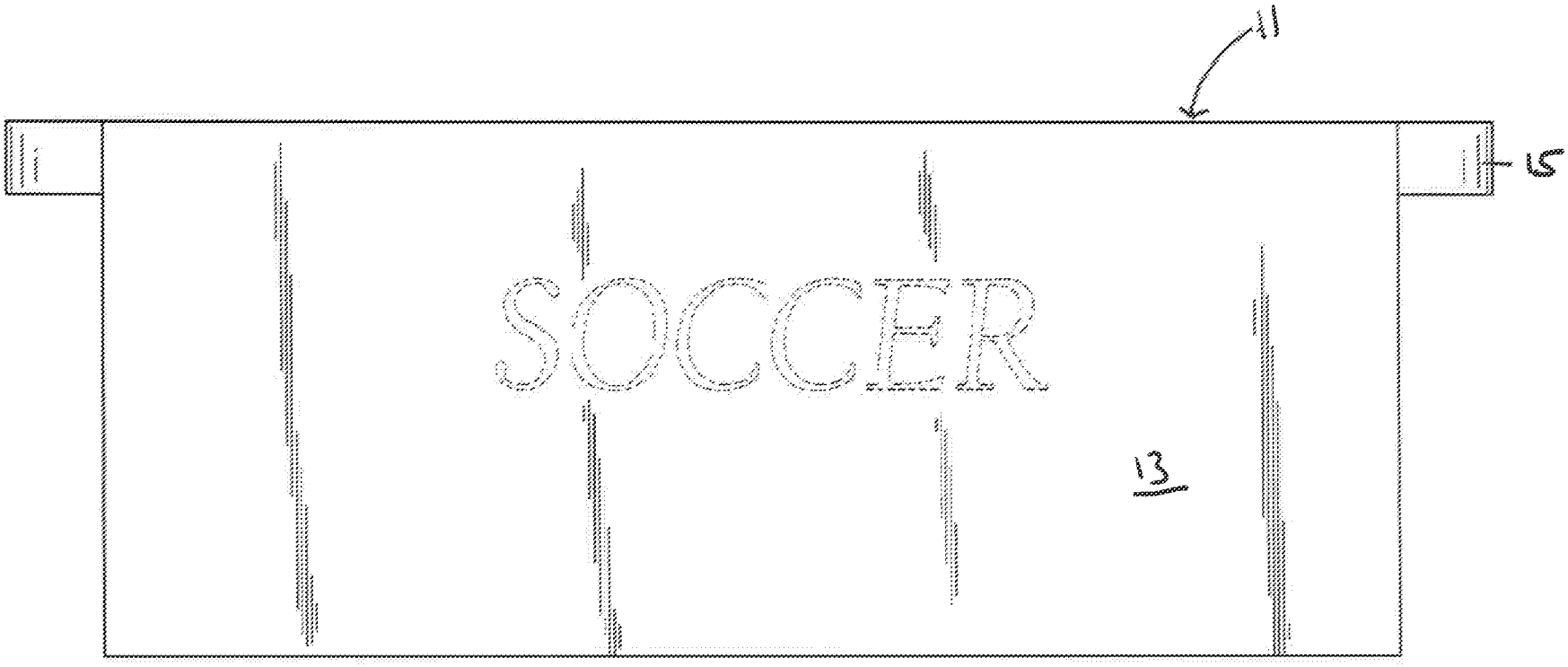
FIG. 9 is a front elevational view of the single-strap one-panel version of the chair sleeve invention.
Figure 10:
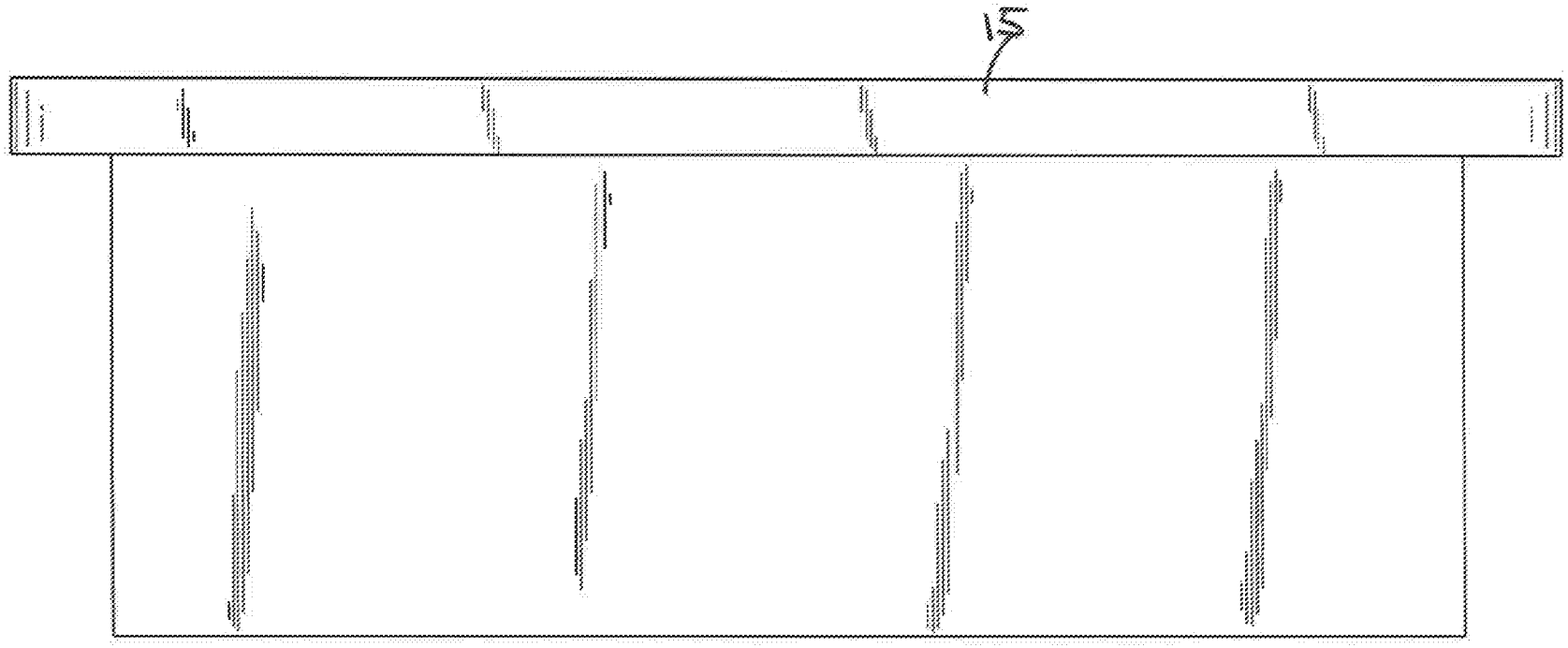
FIG. 10 is a rear elevational view of the single-strap one-panel version of the chair sleeve invention.
Figure 11:
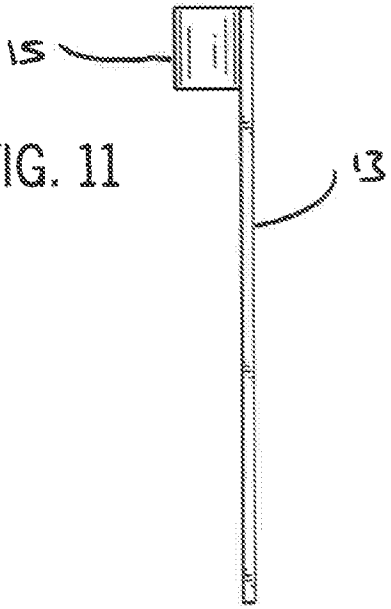
FIG. 11 is a side elevational view of the single-strap one-panel version of the chair sleeve invention.
Figure 12:
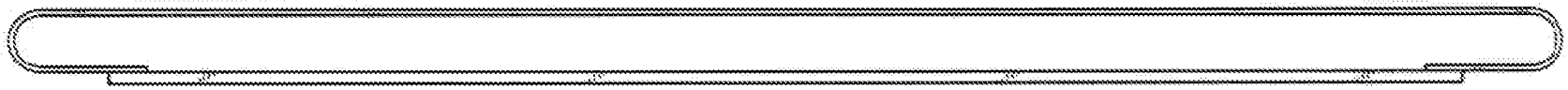
FIG. 12 is a top elevational view of the single-strap one-panel version of the chair sleeve invention.
Figure 13:
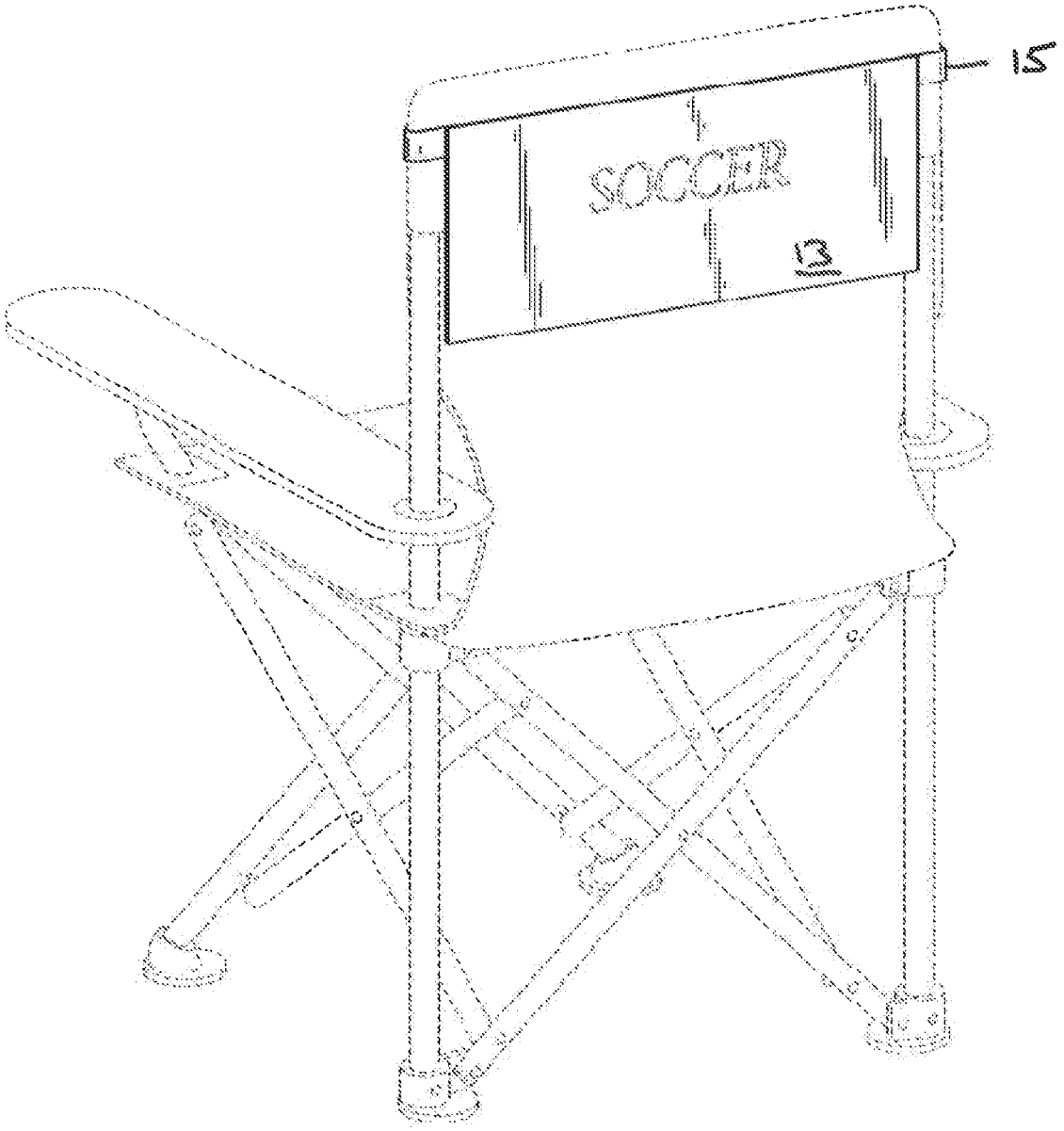
FIG. 13 is a rear and side perspective view of the single-strap one-panel version of the chair sleeve invention installed on a camp chair.
Figure 14:
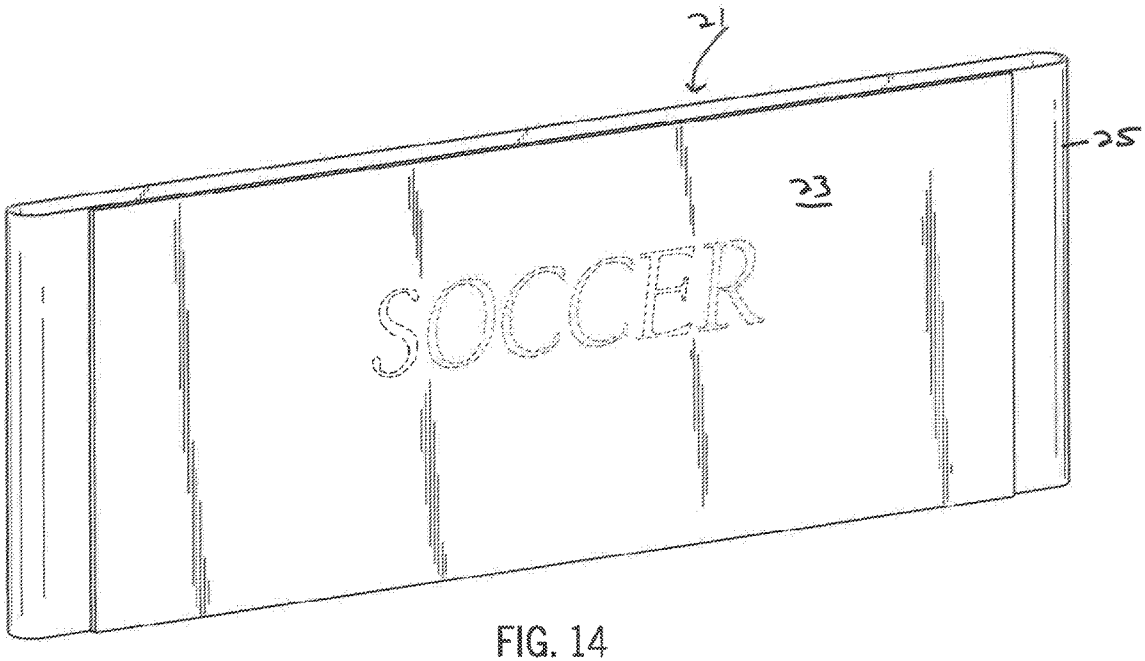
FIG. 14 is a front and side perspective view of the full strap one-panel version of the chair sleeve invention.
Figure 15:
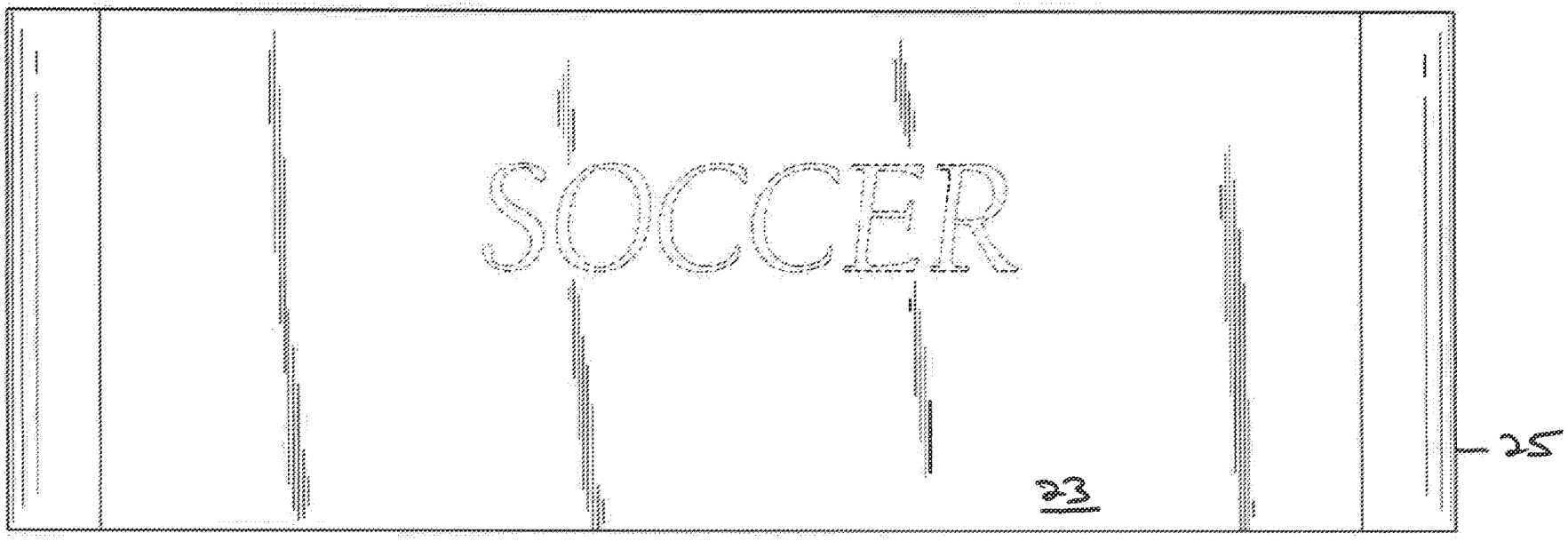
FIG. 15 is a front elevational view of the full strap one-panel version of the chair sleeve invention.
Figure 16:
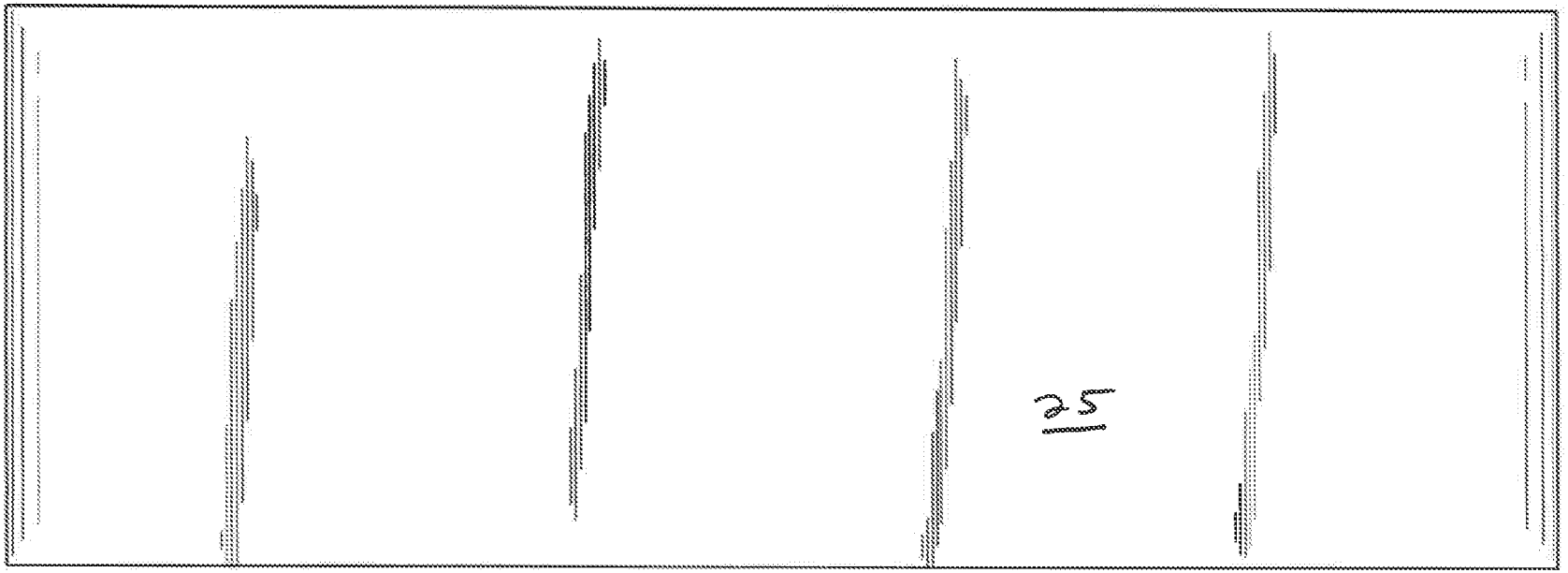
FIG. 16 is a back elevational view of the full strap one-panel version of the chair sleeve invention.
Figure 17:
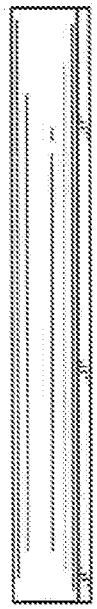
FIG. 17 is a side elevational view of the full strap one-panel version of the chair sleeve invention.
Figure 18:
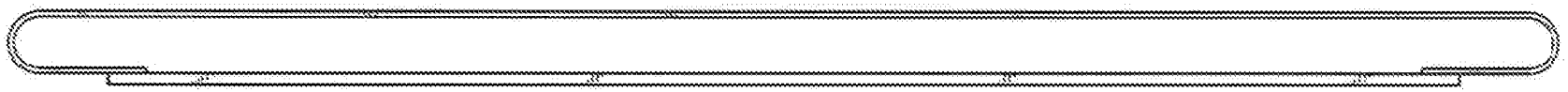
FIG. 18 is a top elevational view of the full strap one-panel version of the chair sleeve invention.

Now referring to the drawings in detail wherein like reference numerals refer to like elements throughout, FIGS. 1-7 show a first embodiment of the claimed invention. FIG. 1 shows two-panel two-strap chair sleeve 1 comprising front panel 3 and back panel 5 connected via straps 7, 9. Straps 7, 9 can comprise elastic material. Front panel 3 and back panel 5 may also comprise elastic material.

FIGS. 8-13 show a second embodiment of the claimed invention, a single strap one-panel version 11 of the chair sleeve. As shown in more detail in FIG. 13, single panel 13 is placed over a chair with the single panel 13 facing to the back. Single-strap 15 is placed around the front of chair to secure the chair sleeve 11. Preferably either the strap 15 or the single panel 13, or both, comprise elastic material so as to firmly secure chair sleeve 11 to chair.

Figure 19:
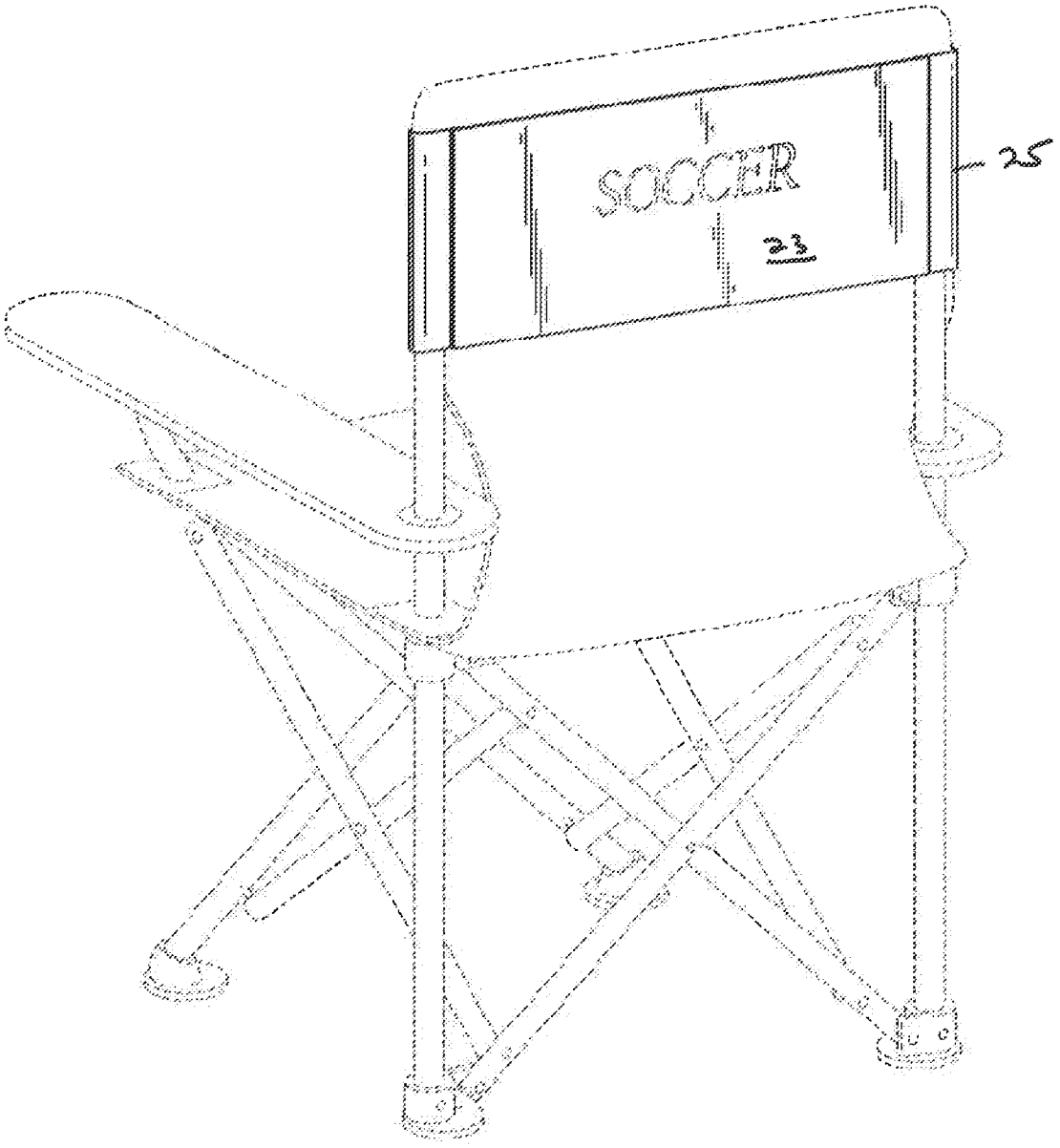
FIG. 19 is a rear and side perspective view of the full strap one-panel version of the chair sleeve invention installed on a camp chair.

FIGS. 14-19 show a third embodiment of the claimed invention a full strap one panel version of the chair sleeve 21 invention. As shown in FIG. 19, single panel 23 is placed on the back of a camp chair while full strap 25 is placed over the camp chair to secure the chair sleeve 21 to the chair.

While the invention has been described with reference to specific embodiments, the description is illustrative of the invention and is not to be construed as limiting. Various modifications and applications of the invention may occur to those with skill in the art without departing from the spirit and scope of the invention.

What is claimed is:

1. A promotional device for use with a chair having a seat and a generally vertical back portion, the promotion device being designed for attachment to the generally vertical back portion of a chair, the promotional device comprising:

a first generally rectangular panel comprising a first short end and a second short end, the first generally rectangular panel being sized so as permit an open area large enough to provide a location for a logo or lettering;

a second generally rectangular panel comprising a first short end and a second short end, the second generally rectangular panel being sized so as permit an open area large enough to provide a location for a logo or lettering;

a first upper strap operable to connect the first short end of the first generally rectangular panel to the first short end of the second generally rectangular panel;

a second upper strap operable to connect the second short end of the first generally rectangular panel to the second short end of the second generally rectangular panel;

a first lower strap operable to connect the first short end of the first generally rectangular panel to the first short end of the second generally rectangular panel; and a second lower strap operable to connect the second short end of the first generally rectangular panel to the second short end of the second generally rectangular panel;

wherein the combination of the first upper strap, the second upper strap, the first lower strap and the second lower strap provide sufficient elasticity so as maintain its vertical position when placed over the generally vertical back portion of a chair.

2. The promotional device of claim 1 wherein the first generally rectangular panel and the second generally rectangular panel are made from an elastic material.

3. A promotional device for use with a chair having a seat and a generally vertical back portion, the promotion device being designed for attachment to the generally vertical back portion of a chair, the promotional device comprising:

a first generally rectangular panel comprising a first short end and a second short end, the generally rectangular panel being sized so as permit an open area large enough to provide a location for a logo or lettering;

a second generally rectangular panel comprising a first short end and a second short end, the generally rectangular panel being sized so as permit an open area large enough to provide a location for a logo or lettering;

a first strap operable to connect the first short end of the first generally rectangular panel to the first short end of the second generally rectangular panel; and a second strap operable to connect the second short end of the first generally rectangular panel to the second short end of the second generally rectangular panel;

wherein the combination of the first strap and the second strap provide sufficient elasticity so as maintain the vertical position of the promotional device when the promotional device is placed over the generally vertical back portion of a chair.

4. The promotional device of claim 3 wherein the first generally rectangular panel and the second generally rectangular panel are made from an elastic material.

5. The promotional device of claim 3 wherein both the first strap and the second strap have the same width as the first generally rectangular panel and the second generally rectangular panel.

* * * * *